US008807160B2

(12) United States Patent
Monterrey

(10) Patent No.: US 8,807,160 B2
(45) Date of Patent: Aug. 19, 2014

(54) FUEL TANK WITH INTERNAL FUEL SHUT-OFF SYSTEM

(75) Inventor: Orestes Y. Monterrey, Wake Forest, NC (US)

(73) Assignee: Florida Marine Tanks, Inc., Hollywood, FL (US)

( * ) Notice: Subject to any disclaimer, the term of this patent is extended or adjusted under 35 U.S.C. 154(b) by 619 days.

(21) Appl. No.: 13/011,985

(22) Filed: Jan. 24, 2011

(65) Prior Publication Data

US 2012/0152375 A1 Jun. 21, 2012

Related U.S. Application Data

(60) Provisional application No. 61/423,137, filed on Dec. 15, 2010.

(51) Int. Cl.
*F16K 31/18* (2006.01)
*B63H 21/38* (2006.01)

(52) U.S. Cl.
CPC ..... *B63H 21/38* (2013.01)
USPC ..... 137/433; 141/198; 220/86.2

(58) Field of Classification Search
USPC ..... 137/41, 43, 202, 583, 587, 429, 433; 141/198; 220/86.2
See application file for complete search history.

(56) References Cited

U.S. PATENT DOCUMENTS 1,878,947 A * 9/1932 Luff et al. ..... 137/433
2,340,936 A * 2/1944 Cook ..... 137/386
4,266,582 A * 5/1981 Sergent ..... 141/198
4,637,426 A * 1/1987 Lyon ..... 137/433
5,152,315 A * 10/1992 Lagache ..... 137/448
5,392,804 A * 2/1995 Kondo et al. ..... 137/202
5,568,828 A * 10/1996 Harris ..... 141/348
5,660,214 A * 8/1997 Pettesch ..... 141/198
5,669,361 A * 9/1997 Weissinger et al. ..... 123/520
5,782,258 A * 7/1998 Herbon et al. ..... 137/43
5,813,434 A * 9/1998 Horiuchi et al. ..... 137/587
5,983,958 A * 11/1999 Bergsma et al. ..... 141/59
6,029,635 A * 2/2000 Sekine et al. ..... 123/516
6,276,387 B1 * 8/2001 Pachciarz et al. ..... 137/43
6,604,539 B1 * 8/2003 Strohmayer et al. ..... 137/43
6,957,658 B2 * 10/2005 Aschoff et al. ..... 137/202
7,318,445 B2 * 1/2008 Ohshiro et al. ..... 137/202
8,464,764 B1 * 6/2013 Milsom ..... 141/198
8,561,657 B2 * 10/2013 Brown et al. ..... 141/303
2008/0264501 A1 * 10/2008 Miyazaki et al. ..... 137/590
2009/0236350 A1 * 9/2009 Miura ..... 220/745

* cited by examiner

*Primary Examiner* — Craig Schneider
*Assistant Examiner* — R. K. Arundale
(74) *Attorney, Agent, or Firm* — The Concept Law Group, P.A.; Scott D. Smiley; Yongae Jun

(57) ABSTRACT

A gas fuel tank with an internal emission fuel system includes a fill-and-vent valve system inside the fuel tank that controls fuel vapor through an exterior carbon canister and prevents spit back. This inventive system prevents exposure of the carbon canister to liquid or fuel. The fill valve assembly has a nylon wedge float that causes the fuel fill nozzle to shut off once the liquid level seals the valve opening. The vent valve assembly also has a nylon wedge float that shuts off vapor once the liquid level seals the valve opening.

6 Claims, 9 Drawing Sheets

100

100

FUEL TANK WITH INTERNAL FUEL SHUT-OFF SYSTEM

CROSS-REFERENCE TO RELATED APPLICATION

This application claims priority to U.S. Provisional Patent Application No. 61/423,137 filed Dec. 15, 2010, the entirety of which is incorporated by reference.

FIELD OF THE INVENTION

The present invention relates generally to fuel tanks, and more particularly relates to a marine fuel tank that prevents the release of gas emissions into the environment as well as "spit back" of fuel during a fuel-filling process.

BACKGROUND OF THE INVENTION

The Environmental Protection Agency ("EPA") has finalized a new evaporative emission control program, scheduled to take effect in the 2011 model year, that will be focused on reducing hydrocarbon, nitrogen oxide, and carbon monoxide emissions from marine spark-ignition ("SI") engines. In particular, the new EPA standards include requirements for controlling "permeation" and "diurnal" emissions from marine vessels, as well as permeation and running loss emissions from small SI equipment.

The term "evaporative emissions" refers to hydrocarbons released into the atmosphere when gasoline or other volatile fuels escape from a fuel container. In recent years, manufacturers of boats and other vehicles have begun migrating from metallic, e.g., aluminum, fuel tanks to fuel tanks made of a plastic compound. The plastic tanks, in comparison to the metallic tanks, are lighter, easier to install, have a low manufacturing cost, and have been found to be acceptably durable. Unfortunately, the primary source of evaporative emissions from non-road gasoline engines and equipment is known as "permeation," which occurs when fuel penetrates the material used in the fuel system and reaches the ambient air. This is especially common through rubber and plastic fuel-system components such as fuel lines and fuel tanks.

Diurnal emissions are another source of evaporative emissions. Diurnal emissions occur as the fuel heats up due to increases in ambient temperature, which causes the liquid fuel to evaporate into the vapor space inside the tank. To protect the tanks from this pressure and prevent pressure buildup, most tanks are provided with vents. The evaporating fuel therefore drives vapors out of the tank through the vent and into the atmosphere. When the ambient temperature cools, e.g., during the night, the fuel vapor once again condenses within the tank.

Running loss emissions are similar to diurnal emissions except that vapors escape the fuel tank as a result of heating from the engine or some other source of heat during operation, rather than from normal daily temperature changes.

All fuel-vapor emissions have been proven to be harmful to humans, as well as to the environment. Therefore, the reduction and control of fuel-vapor emissions remains a concern of the marine industry and is now a requirement by the EPA.

One prior-art attempt to reduce diurnal emissions utilizes a filter, e.g., carbon particles inside a canister-shaped package, which is provided in series with an aeration line connecting the interior of the fuel tank with the environment. While this system reduces emissions for a short time, it has been found that the carbon particles lose their filtering ability when placed into direct contact with fuel and/or water, which is a frequent occurrence with the prior-art design during normal operation of the boat. Attempts have been made to place liquid separator devices between the fuel holding area and the filter, but because fuel still enters the line as it splashes within the tank, these devices are unable to completely prevent the passage of fuel from the tank to the filter.

An additional problem plaguing boat owners as well as the environment is referred to as fuel "spit back." Spit back occurs during the filling process of a fuel tank and results in fuel being sprayed back at the operator due to a pressure build-up within the tank, which pressurizes the fuel fill line. When the operator removes the fuel pump, fuel splashes out of the fill line. This result is not only harmful to humans and the environment, but creates a serious and dangerous potential for explosion. For boats that are subject to the new diurnal standards, they must also be designed and built such that operators can reasonably be expected to fill the fuel tank without spit back or spillage during a fueling event.

Therefore, a need exists to overcome the problems with the prior art as discussed above.

SUMMARY OF THE INVENTION

The invention provides a fuel tank with and internal evaporative emission system that overcomes the hereinafore-mentioned disadvantages of the heretofore-known devices and methods of this general type and that will control evaporative emissions for new non-road spark ignition engines, equipment, and vessels.

With the foregoing and other objects in view, there is provided, in accordance with the invention, a marine vessel fuel system that includes a fuel container defining an interior and an exterior, a fuel-intake port passing from the exterior to the interior of the fuel container and having a diameter, and a fuel shut-off valve at the fuel-intake port, which has at least a portion thereof within the interior of the fuel container. The fuel shut-off valve has a chamber with a first end that is coupled to the fuel-intake port, a second end that is opposite to the first end, and a length between the first end and the second end. The fuel shut-off valve also includes a stopper that is buoyant in liquid, has at least a portion thereof located within the chamber, is movable along the length of the chamber, and is sized to seal the fuel-intake port when it is at the first end of the chamber.

In accordance with a further feature of the present invention, the fuel container is an installed marine fuel tank.

In accordance with an additional feature of the present invention, the chamber is porous thereby allowing liquid to pass from an interior of the chamber to an exterior thereof.

In accordance with another feature of the present invention, the stopper is tapered at one end thereof to allow it to reliably seal the fuel-intake port when at the first end of the chamber.

In accordance with yet a further feature of the present invention, the fuel container has a fuel-holding capacity and the fuel shut-off valve seals the fuel-intake port when an upper surface of the fuel container is tilted approximately 17° from the horizon and approximately 95% of the fuel-holding capacity is occupied with liquid.

In accordance with another feature, an embodiment of the present invention also includes a marine vessel fuel system that includes a fuel container defining an interior, an exterior, a first opening placing the interior in fluid communication with the exterior, and a second opening placing the interior in fluid communication with the exterior. A fuel-intake port is at the second opening and passing from the exterior to the interior of the fuel container and having a diameter. A fuel shut-off valve is at the fuel-intake port and has at least a portion within the interior of the fuel container. The fuel shut-off valve includes a fuel shut-off valve chamber with a first end coupled to the fuel-intake port, a second end opposite the first end, and a length between the first end and the second end. The fuel shut-off valve further includes a fuel shut-off valve chamber stopper that has a buoyancy when placed in liquid and at least a portion thereof located within the chamber. The stopper is movable along the length of the chamber and is sized and shaped to seal the fuel-intake port when at the first end of the fuel shut-off valve chamber. The marine vessel fuel system further includes an emission assembly located within the interior of the fuel container, where the emission assembly includes a passageway that has a watertight length and at least a first opening and a second opening along the watertight length, the first opening of the passageway having a mechanical watertight couple to the first opening of the fuel container. A first emission-assembly chamber has a first end coupled to the second opening of the passageway, a second end opposite the first end of the first emission-assembly chamber, and a length between the first end of the first emission-assembly chamber and the second end of the first emission-assembly chamber. A first emission-assembly stopper has a buoyancy when placed in liquid and at least a portion located within the first emission-assembly chamber. The stopper is movable along the length of the first emission-assembly chamber and is sized and shaped to seal the second opening of the passageway when at the first end of the first emission-assembly chamber.

Although the invention is illustrated and described herein as embodied in a marine fuel tank with an internal evaporative emission system and liquid fuel emission prevention system, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. When "approximately" or "substantially" is used in connection with a degree or percentage, said value may be considered rounded to the nearest significant numeric value or degree and be considered "approximately" or "substantially" said value.

"Diurnal emissions" means evaporative emissions that occur as a result of venting fuel tank vapors during daily temperature changes while the engine is not operating. "Evaporative" means relating to fuel emissions that result from permeation of fuel through the fuel-system materials or from ventilation of the fuel system. "Fuel line" means hoses or tubing designed to contain liquid fuel. "Fuel system" means all components involved in transporting, metering, and mixing the fuel from the fuel tank to the combustion chamber (s), including the fuel tank, fuel tank cap, fuel pump, fuel filters, fuel lines, carburetor or fuel-injection components, and all fuel-system vents. In the case where the fuel tank cap or other components (excluding fuel lines) are directly mounted on the fuel tank, they are considered to be a part of the fuel tank. "Installed marine fuel line" means a fuel line designed for delivering fuel to a marine SI engine. "Marine SI" means relating to vessels powered by engines that are subject to exhaust emission standards in 40 C.F.R. §1045. "Marine vessel" has the meaning given in 40 C.F.R. §1045.801, which generally includes all non-road equipment used as a means of transportation on water. "Sealed" means lacking openings to the atmosphere that would allow a measurable amount of liquid or vapor to leak out under normal operating pressures. "Ullage" means the amount by which a container falls short of being full.

"Installed marine fuel tank" means a fuel tank designed for delivering fuel to a Marine SI engine that does not meet the definition of portable marine fuel tanks. "Portable marine fuel tank" means a fuel tank that has design features indicative of use in portable applications, such as a carrying handle and fuel line fitting that can be readily attached to and detached from a non -road engine and has a nominal fuel capacity of 12 gallons or less.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
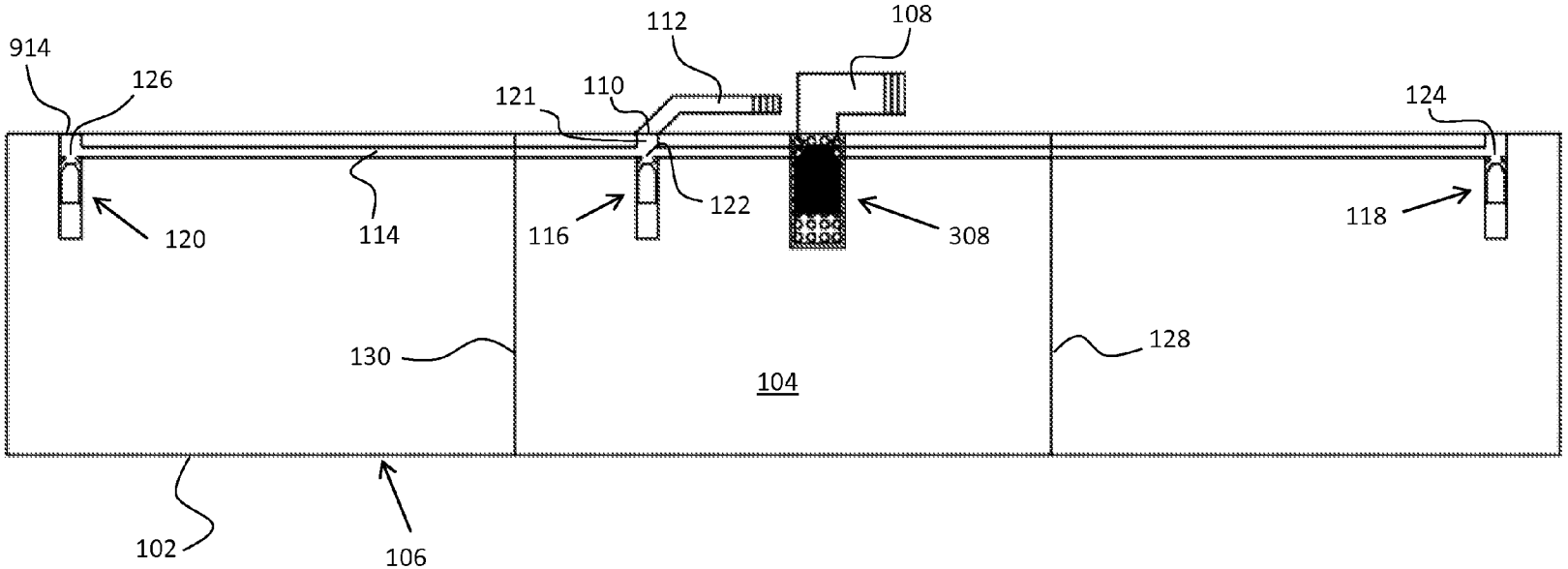
FIG. 1 is an elevational side view of a marine vessel fuel system showing an emission-control assembly and fuel-control assembly in accordance with an exemplary embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient evaporative venting system with multiple automatic selectively-self-sealing ports that seal in response to the proximity between any one of the ports and a level of fuel within tank reaching a predetermined minimum value. Embodiments of the invention also provide a fueling system that prevents the emission of liquid fuel during the fueling process.

Referring now to FIG. 1, one embodiment of the present invention is shown in an elevational side view. FIG. 1 shows several advantageous features of the present invention, but, as will be described below, the invention can be provided in several shapes, sizes, combinations of features and components, and varying numbers and functions of the components. The first example of a marine-vessel fuel system 100, as shown in FIG. 1, includes a fuel container 102, which defines an interior 104 and an exterior 106. The fuel container 102 is of a suitable material, e.g., aluminum, steel, plastic, and others, to hold and contain combustible fuels. The fuel container 102 is sealed and water tight so that liquid residing within the interior 104 is unable to pass to its exterior 106. In one embodiment of the fuel container 102, as shown in FIG. 1, the fuel container 102 includes a set of baffles 128, 130 for reducing liquid movement within the fuel container 102. Advantageously, the marine-vessel fuel system 100 of the present invention includes a novel fuel-control assembly and a novel emission-control assembly, which are both described in detail below.

Fuel Control

Figure 2:
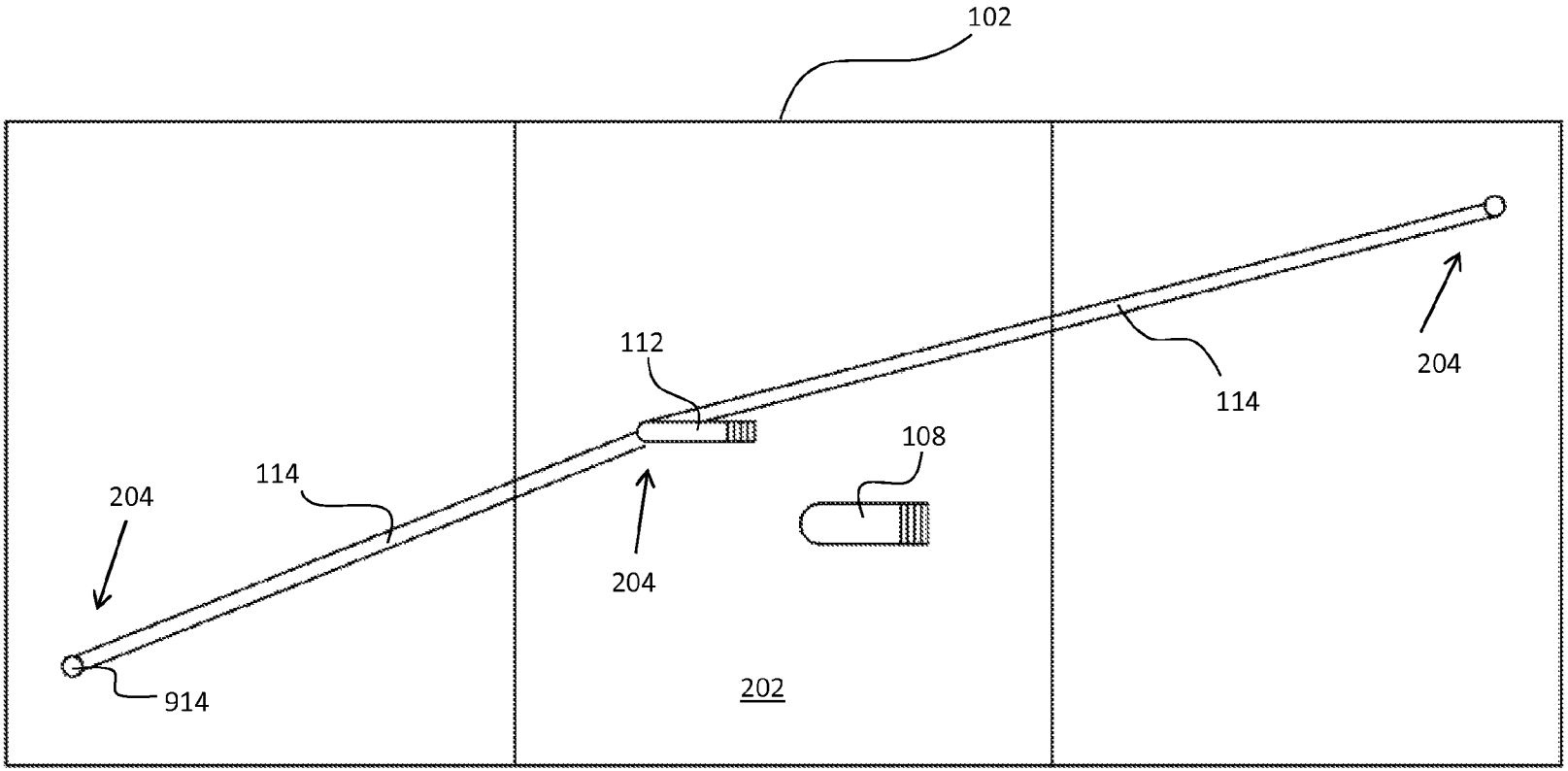
FIG. 2 is a planar top view of the marine vessel fuel system of FIG. 1 showing the emission-control assembly and the fuel-control assembly in accordance with an exemplary embodiment of the present invention.

Describing first the fuel-control assembly, as can also be seen in FIG, 1, the fuel container 102 is provided with a fuel-intake port 108 that passes from its exterior 106 to its interior 104. The fuel-intake port 108 allows fuel to be transferred from outside the interior 104 of the fuel container 102 to within the interior 104 of the fuel container 102. As FIG. 2 shows, one embodiment of the present invention places the fuel-intake port 108 near the center of a top surface 202 of the fuel container 102, although the invention is not limited to any particular location of the fuel-intake port 108. As illustrated in FIGS. 1 and 2, the exemplary baffles 128, 130, of the fuel container 102 can be seen separating the fuel container 102 into third quadrants or one-third sections. The quadrants, however, could be defined by any physical or imaginary surface that sections the container 102 into three equal portions along a width of the container, as shown in FIG. 2. In one embodiment, "near the center" is defined as a located within a second-third section interposed between the first and third sections.

Figure 3:
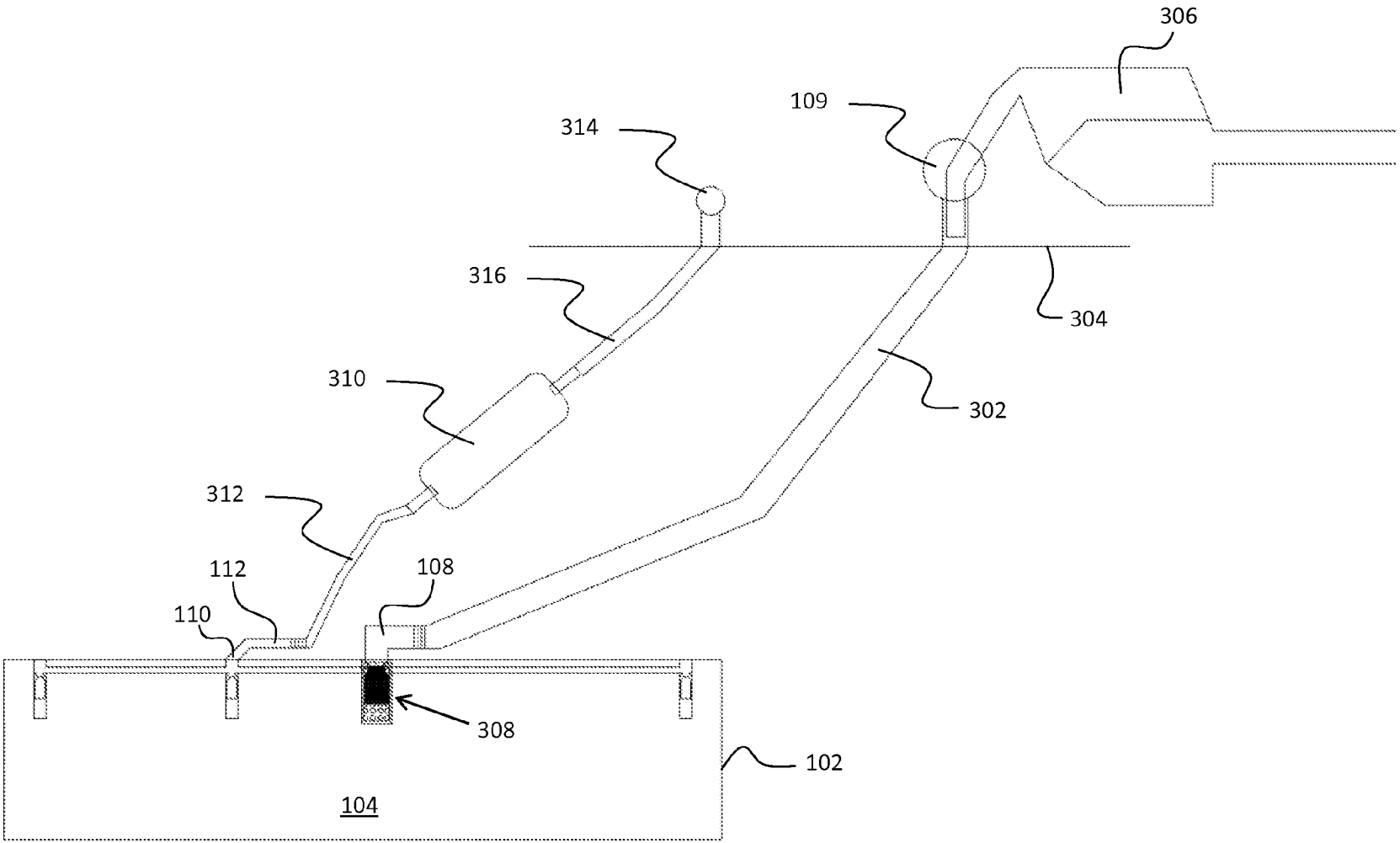
FIG. 3 is an elevational side view of the marine vessel fuel system of FIG. 1 installed within a marine vessel and having a fuel pump connected thereto in accordance with an exemplary embodiment of the present invention.

FIG. 3 provides a cutaway elevational exemplary diagram of the marine-vessel fuel system 100 of FIG. 1 installed within a marine vessel. As FIG. 3 shows, a fuel line 302 spans between the fuel-intake port 108 and a fuel fill port 109 at an edge 304 of a boat. The fuel line 302 is used to transfer fuel from a pump 306 to the interior 104 of the fuel container 102 via the fuel-intake port 108. More specifically, fuel flows out of the pump 306, through the sealed fuel line 302, through the fuel-intake port 108, and into the interior 104 of the fuel container 102. Advantageously, the present invention also provides a fuel shut-off valve assembly 308 within the interior 104 of the fuel container 102 and which is coupled to the fuel-intake port 108. The novel fuel shut-off valve assembly 308 eliminates a problem that has plagued the marine industry for many years—spit back due to pressure within the fuel container 102 exerting force through the fuel line 302 in a direction from the fuel container 102 towards the fuel pump 306.

Figure 4:
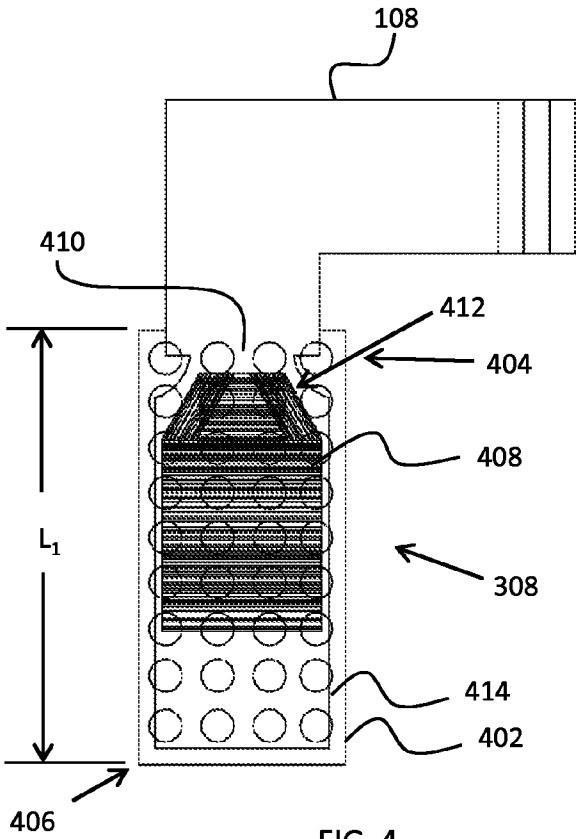
FIG. 4 is an elevational side view of a fuel shut-off valve in accordance with an exemplary embodiment of the present invention.

Referring now to FIG. 4, an elevational close-up view of the novel fuel shut-off valve assembly 308 is shown. The fuel shut-off valve assembly 308 includes a chamber 402 that has a first end 404 coupled to the fuel-intake port 108. A second end 406 of the chamber 402 is opposite the first end 404 and separated by a length $L_1$. The fuel shut-off valve assembly 308 also includes a stopper 408 that is located and movable within the chamber 402 along its length $L_1$. The stopper 408 can be of a plastic or other material that has buoyancy. The buoyancy causes the stopper 408 to move within the chamber 402 when contacted by liquid, when such is present within the interior 103 of the fuel container 102. That is, because the fuel shut-off valve assembly 308 is located at the top of the fuel container 102, when fuel rises in the fuel container 102 to a point where it reaches the fuel shut-off valve assembly 308, the stopper 408 is pushed upward by its buoyancy toward the fuel-intake port 108. It is envisioned that, as is shown in the drawings, the lengthwise direction, indicated as "$L_1$" in FIG. 4, of the chamber is substantially perpendicular to the upper surface 202 of the fuel container 102. However, other angles are possible and advantageous when the installation of the fuel container 102 is at an angle within the vessel in which it is installed.

Advantageously, the stopper 408 and fuel-intake port 108 are sized and shaped so that when the stopper 408 is at the first end 404 of the chamber 402, where it makes contact with the fuel-intake port 108, the exit 410 of the fuel-intake port 108 is sealed by the stopper 408. In other words, when the stopper 408 is at the first end 404 of the chamber 402, fuel within the fuel container 102 is unable to pass through the exit 410 of the fuel-intake port 108 and move towards the fuel pump 306. This feature provides a great advantage over prior-art fuel tanks. More specifically, as the fuel fills the fuel container 102, pressure builds due to the air in the tank being forced out. With prior-art fuel containers, this pressure results in fuel being propelled toward the user holding the fuel pump handle 306 and, in particular, at the point when the fuel pump handle 306 is removed from the fuel line 302. Because the inventive fuel shut-off valve assembly 308 seals the exit 410 of the fuel-intake port 108 with the stopper 408, pressure within the fuel container 102 is unable to force the fuel up the fuel line 302 and the well-known "spit back" problem is obviated.

In accordance with an embodiment of the present invention, the stopper 408 is provided with a tapered upper portion 412. This taper 412 allows the stopper 408 to reliably mate with and seal the exit 410 of the fuel-intake port 108. In the exemplary embodiment, the tapered upper portion 412 is formed as a beveled edge at a top end of the stopper 408. Of course, the taper is not a necessary feature of the present invention. In addition, a sub-chamber 414, which can also be embodied as an interior wall of the main chamber 402, can reside within the main chamber 402. The sub-chamber 414 is provided with at least one ear 506 (shown in FIG. 5) that serves to guide the stopper 408 upward towards the exit 410 of the fuel-intake port 108. In the exemplary embodiment, as shown in at least FIG. 4, the beveled edge tapered upper portion 412 is configured to engage the at least one guide ear 506 when the stopper 408 is pushed upward by a buoyance force of liquid in the fuel container 102 to seal the fuel intake port 108.

Figure 5:
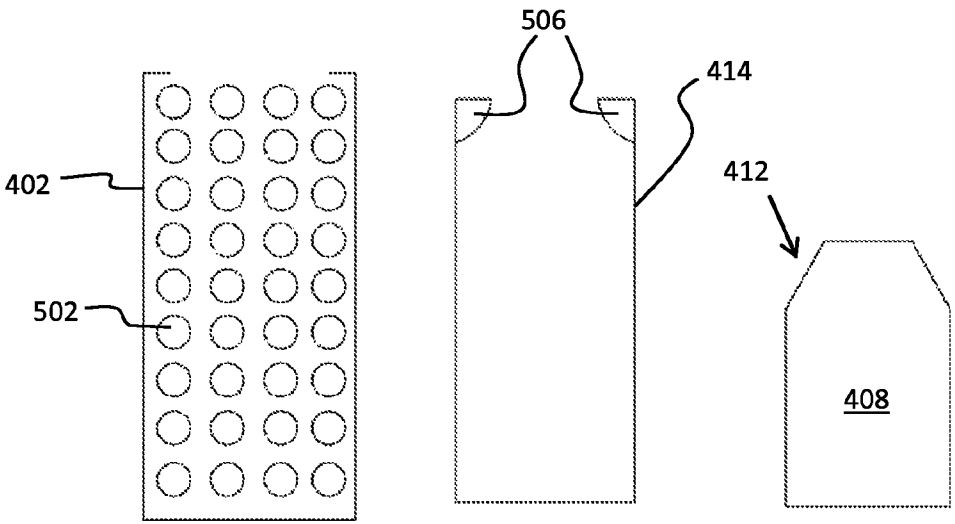
FIG. 5 is an elevational exploded view of the fuel shut-off valve of FIG. 4.

As shown in FIG. 4 and in the exploded view of FIG. 5, one embodiment of the chamber 402 is porous, i.e., provided with a plurality of apertures 502. The apertures 502 provide multiple advantageous. For one, they readily allow fuel to flow through the chamber 402 and into the fuel container 102. Second, they allow impurities within the fuel, which enter the fuel container 102 through the exit 401 of the fuel-intake port 108, to easily exit the chamber and not interfere with the stopper's ability to slide back and forth therein. In short, they act as a self-cleaning feature.

Figure 6:
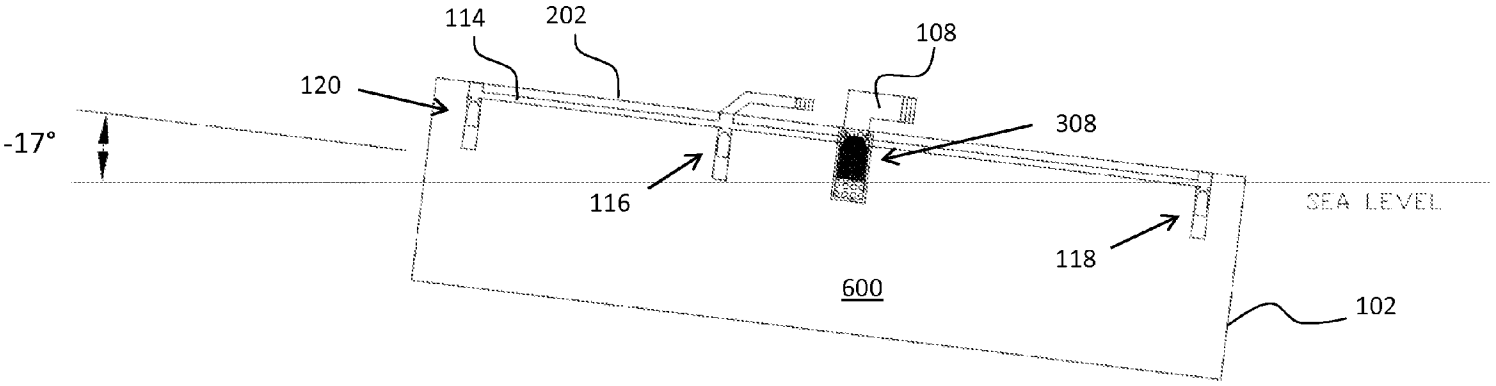
FIG. 6 is an elevational side view of the marine vessel fuel system of FIG. 1 installed at a −17° angle and filled to about a 95% capacity and showing the fuel shut-off valve and at least one of the emission-control valves closed in accordance with an exemplary embodiment of the present invention.
Figure 7:
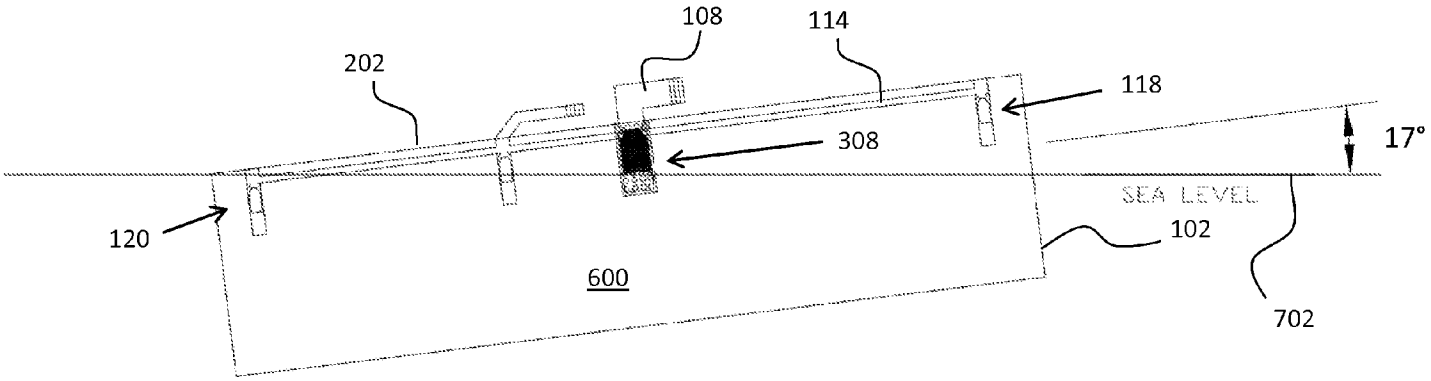
FIG. 7 is an elevational side view of the marine vessel fuel system of FIG. 1 installed at a 17° angle and filled to about a 95% capacity and showing the fuel shut-off valve and at least two of the emission-control valves closed in accordance with an exemplary embodiment of the present invention.

Although not required, it is envisioned that the presently-inventive fuel system 100 includes a fuel container 102 that is an "installed marine fuel tank," as has been defined herein. As an installed marine fuel tank, it is common for the fuel container 102 to rest at an angle to the horizon, with the angle depending on the type of vessel in which it is installed. Specific regulatory requirements require marine (and other) fuel tanks to only be filed to a certain capacity, e.g., to only 95% of the total fuel-holding capacity of the fuel container 102. Referring now to FIGS. 6 and 7, in each, the fuel container 102 is positioned at a 17° angle to the surface of the water, with FIG. 6 showing what is referred to herein as a −17° angle. Some marine standards require installation of fuel containers in vessels less than 26' in length to be at a 17° angle (or −17°. Those of larger vessels can be less of an angle. Advantageously, the present invention provides the fuel shut-off valve assembly 308 at a location on the upper surface 202 of the fuel container 102 so that the stopper 408 seals the fuel-intake port 108 when approximately 95% of the fuel-holding capacity is occupied with liquid 600. This sealing causes the fuel to back up inside the fuel line 302, which causes a sensor inside the pump 306 to trigger and stop flow of fuel. This sensor is well-known and is found in substantially all commercial fuel pumps for vehicles. Of course, the size of the fuel shut-off valve 308 and/or its components is determinative of when the intake port 108 will be sealed off, but is still determinative of where the fuel shut-off valve 308 is positioned within the interior 104 of the fuel container. The present invention is in no way restricted to an angle of 17°, nor is it restricted to stopping refilling at 95% of the total capacity of the interior 104 of the fuel container. Advantageously, the inventive shut-off valve 308 can be positioned or sized to provide stoppage of filling at any volume or angle, depending on the goal of the application.

Emission Control

Referring now back to FIGS. 1 and 2, an additional novel aspect of the present invention is shown. Referring first to FIG. 2, an emission-control assembly 204 is shown in the downward-looking elevational view of the top surface 202 of the inventive marine-vessel fuel system 100. The particular embodiment of the emission-control assembly 204 shown in FIG. 2 spans from one half of the fuel container 102 to the other half. Near the center of the upper surface 202 is emission vent 110, which can best be seen in FIG. 1. The emission vent 110 is an opening in the fuel container 102 that places the interior 104 in fluid communication with the exterior 106. Inserted within or coupled to the opening 110 is an emission port 112. Referring to FIG. 3, a first emission hose 312 couples the emission port 112 to the carbon canister 310, which is coupled to an emission vent 314 at the edge of the boat 304 by a second emission hose 316.

Referring now back to FIG. 2, the emission-control assembly 204, which is located within the interior 104 of the fuel container 102, is shown coupled to the emission port 112, through the opening 110 (not visible in this view). The emission-control assembly 204 includes a passageway 114 that is conduit through which vaporous gas is able to be communicated from one location to another. Although the passageway 114 is provided with one or more openings, the passageway 114 is otherwise sealed and watertight. With regard to the one or more openings, the passageway 114 has a first opening 121 that is mechanically coupled to the emission vent 110. The passageway 114 also has at least a first emission shut-off valve 116, a second emission shut-off valve 118, and a third emission shut-off valve 120, although not all three are required and additional emission shut-off valves can also be provided. The first emission shut-off valve 116 is at a second opening 122 of the passageway 114, the second emission shut-off valve 118 is at a third opening 124 of the passageway 114, and the third emission shut-off valve 120 is at a fourth opening 126 of the passageway 114. The second opening 122, the third opening 124, and the fourth opening 126 are fluidly coupled to the opening 110 of the fuel container 102 through the closed passageway 114 and the first opening 121.

Figure 9:
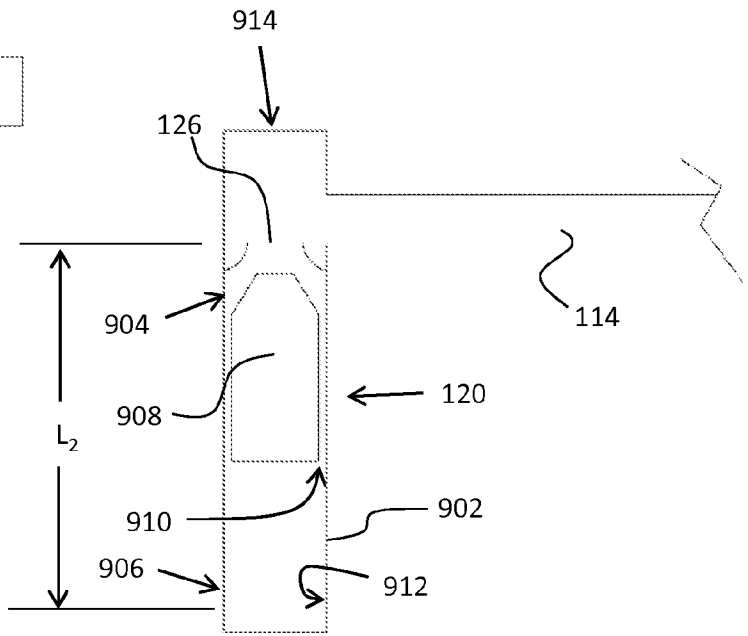
FIG. 9 is an elevational side view of an emission-control valve at an end of an emission passageway in accordance with an exemplary embodiment of the present invention.
Figure 8:
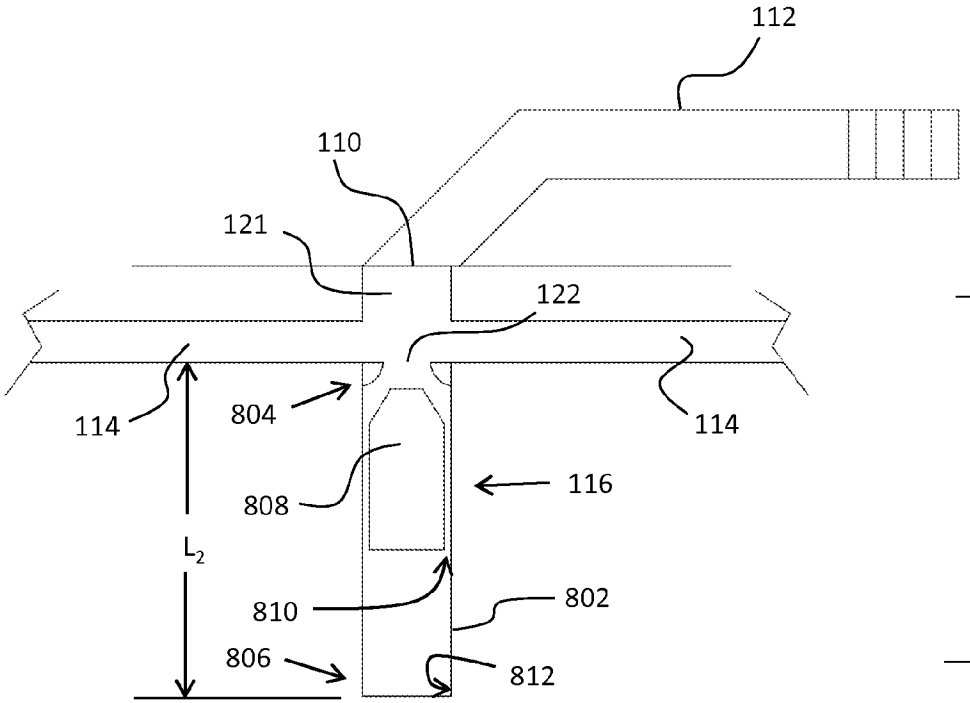
FIG. 8 is an elevational side view of an emission-control valve at a central location along an emission passageway in accordance with an exemplary embodiment of the present invention.

Referring now to FIGS. 8 and 9, exemplary emission shut-off valves are shown, with FIG. 8 showing an embodiment of the first emission shut-off valve 116 that is at a central location along the passageway 114 and FIG. 9 showing an embodiment of the second or third emission shut-off valves 118, 120, which are at ends of the passageway 114. Referring first to FIG. 8, the first emission shut-off valve 116 includes a first chamber 802 having a first end 804 coupled to the second opening 122 of the passageway 114. A second end 806 is opposite the first end 804 of the first chamber 802 and is separated from the first end 804 by a length $L_2$.

A stopper 808 is present within the chamber 802 or within at least a portion of the chamber 802 and is movable within the chamber 802 between the first end 804 and the second end 806. As with the stopper 408 of the fuel shut-off valve 308, the emission stopper 808 exhibits a buoyancy property when placed in liquid. A few exemplary stopper materials are BUNA NITRILE, plastic material, cork, and others. In addition, in accordance with an embodiment of the present invention, the stopper 808 is sized to seal the second opening 122 of the passageway 114 when it is at the first end 804 of the first chamber 802. As FIG. 8 also shows, there is a gap 810 between the stopper 808 and the interior wall 812 of the chamber 802. When the stopper 808 is not at the first end 804 of the chamber 802, fuel vapor and air can pass between the stopper 808 and chamber wall 812, into the second opening 122, through the first opening 121, through the emission vent 110, and through the emission port 112. However, when the stopper 808 is at the first end 804 of the chamber 802, the second opening 122 is sealed and gas vapors can no longer escape the fuel container 102 through the first emission shut-off valve 116. Similarly, liquid fuel is also prevented from passing through the second opening 122 by the first emission shut-off valve 116. This feature provides a tremendous advantage over the prior-art fuel tanks. Namely, fuel is prevented from entering the passageway 114 by each of the emission shut-off valves 116, 118, 120 when fuel rises to within a close proximity of one of the openings 122, 124, 126, respectively, being protected by the emission shut-off valve 116, 118, 120. This selectively self-sealing feature protects the carbon canisters 310 from intrusion of moisture.

Referring now to FIG. 9, an exemplary configuration of one of the second and third emission shut-off valves 118, 120 is shown. For purposes of discussion, the emission shut-off valve of FIG. 9 will be referred to as being representative of the third emission shut-off valve 120. The third emission shut-off valve 120 includes a chamber 902 having a first end 904 coupled to the fourth opening 126 of the passageway 114. A second end 906 is opposite the first end 904 of the third chamber 902, which are separated by a length $L_3$.

A stopper 908 is present within the third chamber 902 or within at least a portion of the third chamber 902 and is movable within the third chamber 902 between the first end 904 and the second end 906. As with the stopper 408 of the fuel shut-off valve 308, the emission stopper 908 exhibits a buoyancy property when placed in liquid. In addition, in accordance with an embodiment of the present invention, the stopper 908 is sized to seal the fourth opening 126 of the passageway 114 when it is at the first end 904 of the third chamber 902. As FIG. 9 also shows, there is a gap 910 between the stopper 908 and the interior wall 912 of the chamber 902. When the stopper 908 is not at the first end 904 of the chamber 902, fuel vapor and air can pass between the stopper 908 and chamber wall 912, into the fourth opening 126, through the first opening 121 (shown in FIG. 8), through the emission vent 110 (shown in FIG. 8), and through the emission port 112 (shown in FIG. 8). However, when the stopper 908 is at the first end 904 of the chamber 902, the fourth opening 126 is sealed and gas vapors can no longer escape the fuel container 102 through the third emission shut-off valve 120. Similarly, liquid fuel is also prevented from passing through the fourth opening 126 by the third emission shut-off valve 120. FIG. 9 also shows a surface 914 of the passageway 114 that is used to couple the passageway 114 to an interior of the upper surface 202. This coupling of the surface 914 and the interior of the upper surface 202 is shown in FIGS. 1 and 2.

Referring again to FIG. 7, the installed marine fuel tank 102 is positioned at about a 17° angle to the surface of the water 702. Advantageously, the present invention provides the first 116 and third 120 emission shut-off valve assemblies at locations on the upper surface 202 of the fuel container 102 so that the stopper in each, 808, 908, respectively, seals the second 122 and fourth 126 openings, respectively, of the passageway 114 when approximately 95% of the fuel-holding capacity is occupied with liquid 600. This sealing prevents fuel from entering the passageway 114 through the second 122 and fourth 126 openings. Advantageously, venting of the fuel container 102 can continue to occur through the third opening 124 of the passageway 114, which is furthest away from the fuel level within the fuel container 102.

Of course, the size of the emission shut-off valves and/or their components is determinative of when the emission shut-off valves will be sealed off. However, a combination of the physical aspects and the placement of the emission shut-off valves within the interior 104 of the container 102 is determinative of the quantity and location of fuel within the fuel container 102 that will cause one or more of the openings 122, 124, 126 to be sealed at a particular angle of the fuel container 102.

FIG. 6 shows only the second emission shut-off valves 118 being sealed when the fuel container 102 is held at a −17° angle, i.e., opposite the angle shown in FIG. 7. Through the utilization of at least two emission shut-off valve assemblies, each at a location within the fuel container 102 substantially different from the other, evaporation and other gaseous pressure build-ups can be exhausted while liquid fuel is simultaneously prevented from entering the exhaust pathway, i.e., the passageway 114. This exhaust takes place into a filter 301, which can now reliably operate to filter the exhaust without introduction of liquid into the filter. Advantageously, the filters will last longer, thereby resulting in less maintenance and expense to the operator of the vessel.

Figure 10:
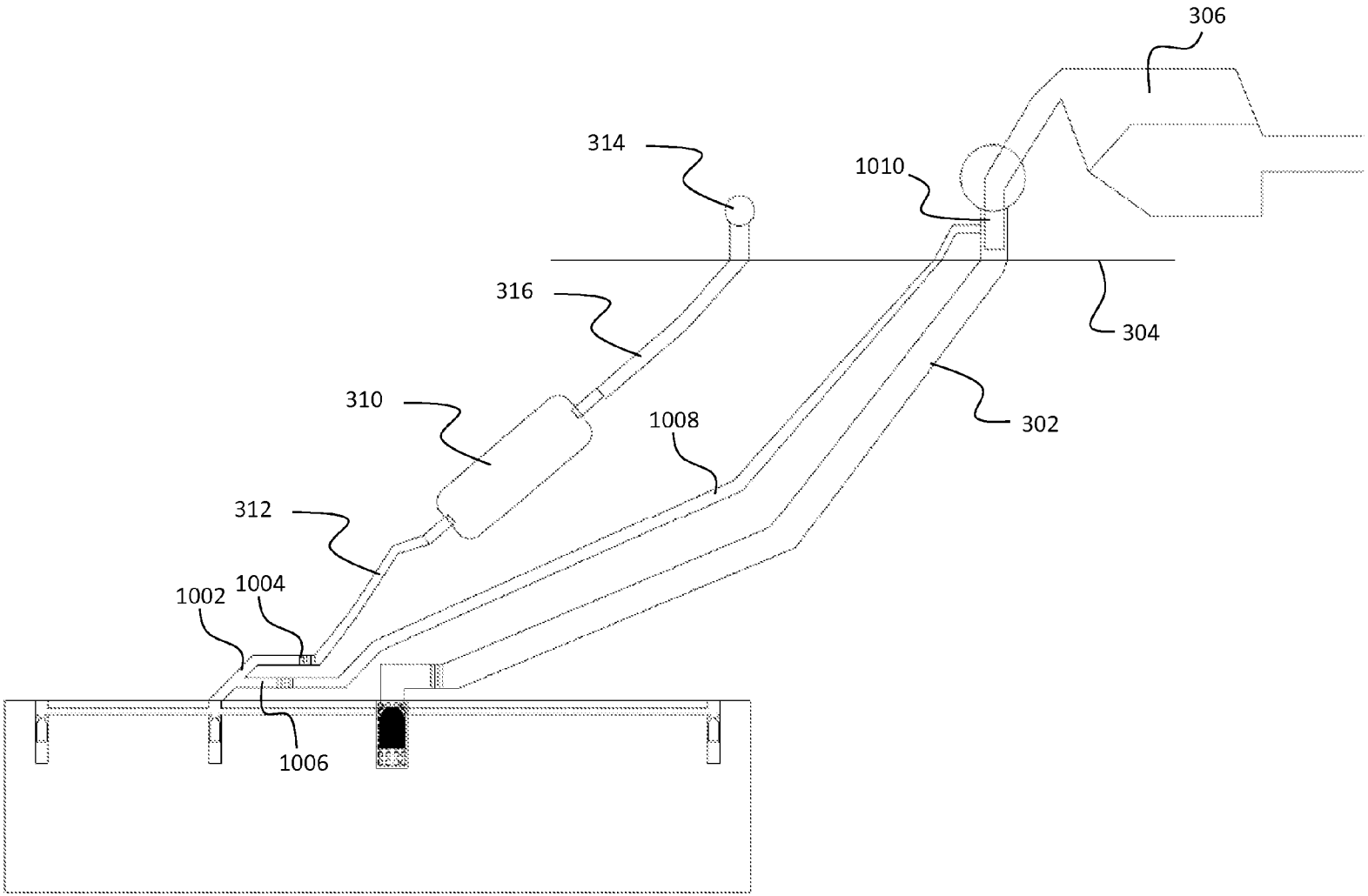
FIG. 10 is an elevational side view of the marine vessel fuel system of FIG. 1 installed within a marine vessel and having an emission multi-port coupling the emission control assembly to an exterior emission vent and the fuel fill port at the surface of the boat in accordance with an exemplary embodiment of the present invention.

FIG. 10 shows an elevational side view of the inventive emission control system with an alternate venting configuration. In the embodiment of FIG. 10, the emission port 112 shown in FIG. 3 has been replaced with an emission multi-port 1002, which features a first 1004 and a second 1006 emission nozzle. The first emission nozzle 1004 is coupled to the first emission hose 312, as was the configuration of FIG. 3. However, with the embodiment of FIG. 10, a second emission nozzle 1006, which is in fluid communication with the first emission nozzle 1004, is coupled to an auxiliary hose 1008. The auxiliary hose 1008 is, in turn, coupled to the fuel fill port 1010 at the surface 304 of the boat. The second emission nozzle 1006 and auxiliary hose 1008 allow for improved equalization of pressure during a fuel filling event, as air/vapor can exit the container through the fuel fill port 1010. Once the fuel filling process is complete, a cap (not shown) is placed over the fuel fill port 1010, thereby returning the system to a single vent (emission vent 314) configuration.

Figure 11:
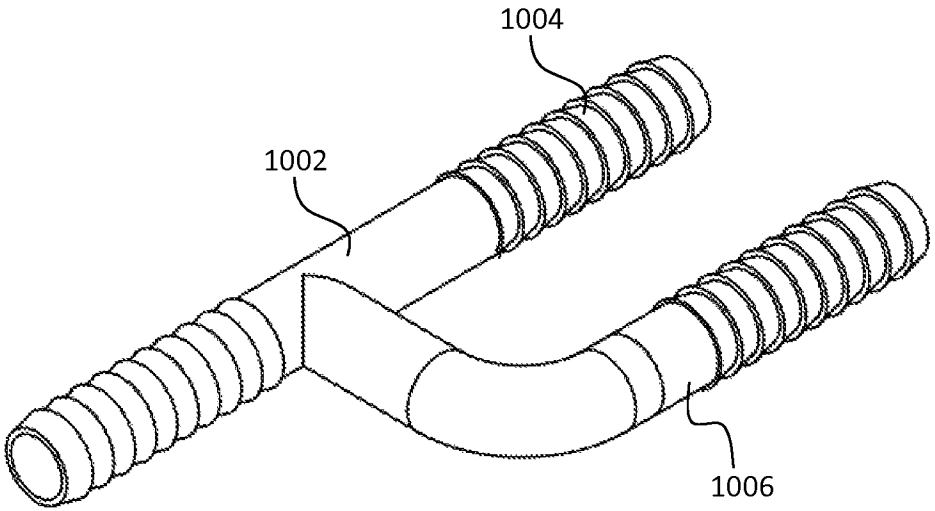
FIG. 11 is a perspective view of the emission multi-port of FIG. 10 in accordance with an exemplary embodiment of the present invention.

FIG. 11 provides a perspective view of an exemplary embodiment of the emission multi-port 1002.

Figure 12:
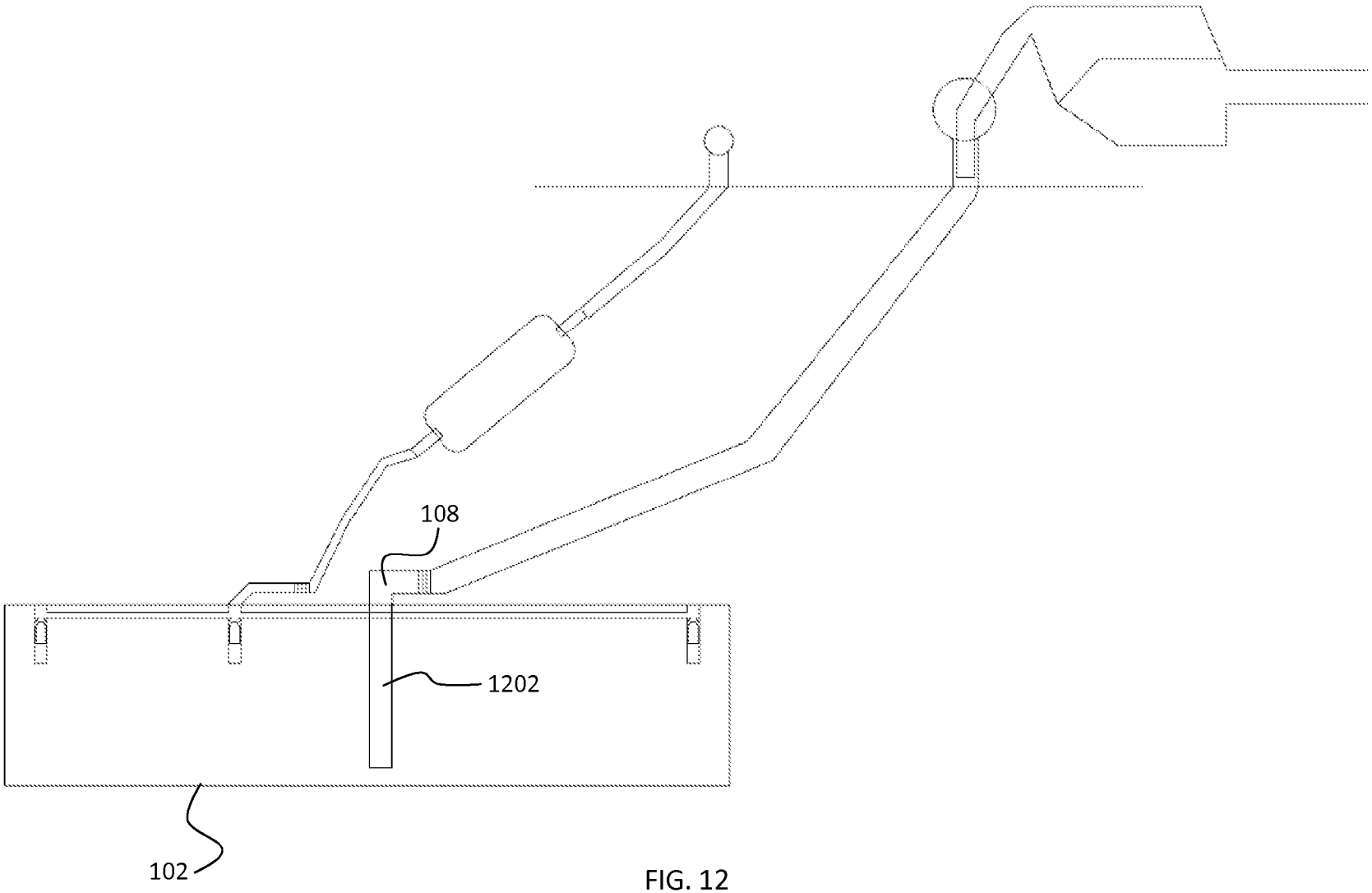
FIG. 12 is an elevational side view of a marine vessel fuel system with an elongated fuel-fill valve in accordance with an exemplary embodiment of the present invention.

FIG. 12 is an elevational side view of a marine vessel fuel system with an elongated fuel-fill valve 1202 in accordance with an exemplary embodiment of the present invention. The elongated fuel-fill valve 1202 extends deep within the fuel container 102. When fuel is added, it rises to and above the bottom lip 1204 of the elongated fuel-fill valve 1202. When fuel reaches the lip 1204, vapors can no longer rise up and exhaust through the fuel-intake port 108.

The present invention provides an emission control system with the combination of a fuel tank, carbon canister, internal fill valve, and internal vent valve. The gas tank can be filled with an exterior gas nozzle so that fuel enters the tank through a fill-valve system. As fuel enters the tank, the tank is advantageously able to vent from multiple locations. As the tank is filled at a demonstrated vessel angle, a shut-off fill valve will shut off when the fuel level has reached the shut-off fill valve. Immediately after the fill valve is shut off, the pump nozzle will shut off and prevent fuel from spitting back. The inventive fuel-tank system also provides an ullage, which is created within the fuel container. This ullage area also has a vent valve that remains open and, advantageously, allows vapor to be filtered and transferred through a carbon canister.

Although described in connection with marine vessels, the present invention is in no way limited to any particular vessel, vehicle, or application. In fact, the present invention can be utilized in applications that do not necessarily involve fuel.

What is claimed is:

1. A marine vessel fuel system comprising:

a fuel container housed within a marine vessel, the fuel container defining an interior and an exterior;

a fuel-intake port located at a fuel-intake opening defined by a top surface of the fuel container and near a center of the top surface of the fuel container, the fuel-intake port passing from the exterior to the interior of the fuel container and having a diameter; and a fuel shut-off valve located at the fuel-intake port and having at least a portion within the interior of the fuel container, the fuel shut-off valve having:

a chamber having a first end defining the fuel-intake opening at the top surface of the fuel container, a second end opposite the first end, and a length between the first end and the second end; and a fuel shut-off valve stopper:

having a buoyancy when placed in liquid;

having at least a portion located within the chamber;

movable along the length of the chamber from the fuel-intake opening at the first end of the chamber to the second end of the chamber; and sized and configured to seal the fuel-intake opening at the top surface of the fuel container when the fuel shut-off valve stopper is moved, by a buoyance force of liquid within the chamber, to the fuel-intake opening;

wherein the fuel shut-off valve is adapted to remain in an unsealed configuration until liquid in the fuel container reaches a predetermined capacity.

2. The marine vessel fuel system according to claim 1, wherein:

the chamber includes at least one guide ear located proximate the first end of the chamber, the at least one guide ear configured to guide the stopper upward towards the fuel-intake opening.

3. The marine vessel fuel system according to claim 2, wherein:

the stopper includes a beveled edge at a top end thereof and wherein the beveled edge is configured to engage the at least one guide ear when the stopper is pushed upward by the buoyancy force to seal the fuel-intake opening.

4. The marine vessel fuel system according to claim 1, wherein:

the chamber is porous thereby allowing liquid to pass from an interior of the chamber to an exterior thereof.

5. The marine vessel fuel system according to claim 1, wherein:

the length of the chamber is substantially perpendicular to an upper surface of the fuel container.

6. The marine vessel fuel system according to claim 1, wherein:

the fuel container has a fuel-holding capacity;

the fuel shut-off valve seals the fuel-intake port when an upper surface of the fuel container is tilted approximately 17° from the horizon; and the predetermined capacity is approximately 95% of the fuel-holding capacity.

* * * * *